United States Patent [19]

Ito et al.

[11] 3,990,274

[45] Nov. 9, 1976

[54] APPARATUS FOR CONTINUOUSLY PROCESSING FABRIC

[75] Inventors: Shogo Ito; Kousei Takasan, both of Kaga, Japan

[73] Assignees: Teijin Limited, Osaka; Kitanippon Dyeing and Finishing Co. Ltd., both of Japan

[22] Filed: May 15, 1975

[21] Appl. No.: 577,926

Related U.S. Application Data

[63] Continuation of Ser. No. 415,413, Nov. 13, 1973, abandoned.

[52] U.S. Cl. ..... 68/158; 68/175; 68/184; 68/207

[51] Int. Cl.[2] ..... D06B 3/28

[58] Field of Search ..... 68/43, 44, 62, 158, 68/175, 177, 181 R, 183, 184, 205 R, 207

[56] References Cited

UNITED STATES PATENTS

| | | | |
|---|---|---|---|
| 862,233 | 8/1907 | Bernhardt | 68/205 R |
| 1,999,317 | 4/1935 | Brix | 68/177 X |
| 2,712,977 | 7/1955 | Keggin | 68/181 R X |
| 3,849,068 | 11/1974 | Meier-Windhorst | 68/181 R X |

FOREIGN PATENTS OR APPLICATIONS

| | | | |
|---|---|---|---|
| 59,773 | 2/1954 | France | 68/43 |
| 18,047 | 6/1970 | Japan | 68/175 |
| 15,792 | 8/1963 | Japan | 68/183 |
| 19,188 | 8/1972 | Japan | 68/181 R |
| 467,257 | 1937 | United Kingdom | 68/181 R |
| 573,042 | 11/1945 | United Kingdom | 68/158 |

*Primary Examiner*—Philip R. Coe
*Attorney, Agent, or Firm*—Sherman & Shalloway

[57] ABSTRACT

The present invention relates to an apparatus for continuously carrying out washing, raising milling, scouring, bleaching and dyeing, of fabric. In carrying out the aforesaid operations, it is essential for the fabric to be carried forward in a stabilized and relaxed state accurately and continuously in a treating fluid and on the other hand the treating fluid should move vigorously without a hitch and come into contact with the fabric uniformly. In the present invention the stabilized posture of the fabric particularly in a treating space is emphasized and at the entry of the treating space the fabric is folded in the wavy form in good order resulting in the more uniform contact between the treating fluid or liquor and the fabric. Further jet or blowing angles of jet nozzles have been arranged to make jets of the treating liquor accurately strike the fabric. Treatment effect has thus been improved by holding properly the fabric in the treating space and blowing the treating liquor from both sides of the fabric on to the fabric.

2 Claims, 5 Drawing Figures

APPARATUS FOR CONTINUOUSLY PROCESSING FABRIC

This is a continuation of application Ser. No. 415,413, filed Nov. 13, 1973, and now abandoned.

The present invention relates to an apparatus for continuously processing fabric in washing, raising, milling, scouring, bleaching and dyeing. For instance, in conducting even and uniform raising or brushing, it is essential to bring the fabric into even contact with a treating fluid and allow the treating fluid to penetrate the whole of the fabric. Further it is preferred to carry the fabric forward accurately in a stabilized and relaxed state in the treating fluid and to allow the treating fluid to move vigorously without a hitch and impinge on the fabric. In other treatments, the same principles apply.

In conventional fabric-processing apparatus of the early stage, a conveyor belt permeable to fluid has been horizontally disposed in a treating fluid to carry fabric thereon in a given direction and cause it to come in contact with the treating fluid, or a plurality of nozzles have been disposed above the conveyor belt, for blowing the fluid onto the moving fabric on the belt.

According to these treating processes, some parts of the moving fabric are short of tension and carried forward while being folder or creased resulting in its insufficient contact with the treating fluid, and other parts are subjected to an excessive tension and retain drawing distortions. In the improved apparatus, two up and down endless conveyor belts permeable to fluid are horizontally disposed and a space is formed between the lower run of the upper belt and the upper run of the lower belt to hold and carry fabric loosely between them.

In Japanese patent publication No. 26464/72, a horizontal upper belt and a U-shaped lower belt are combined to form a U-shaped fabric carrying path. While being retained in the path, the fabric is carried forward in the treating fluid. Along the treating path oscillating beaters are arranged at appropriate intervals to beat the moving fabric. In Japanese patent publication No. 26462/72, fabric is held in a treating space formed by two up and down conveyor belts; jet nozzles are disposed on the outside of face of the conveyor belt zigzag or face to face to blow a treating fluid and give oscillations from the outside to the upper and lower conveyor belts.

The conventional apparatus have been modified and improved and new devices have been added by the present invention. The present apparatus of the invention is the same as them in that it comprises a treating tank containing a treating fluid, a treating space for holding fabric between two up and down conveyor belts permeable to fluid, which are disposed almost horizontally in the tank and a fluid blowing means in the treating space for blowing the fluid on to the fabric.

As described above, these devices are well known, with the careless use of the apparatus, sufficient treatment cannot be effected and such difficulties as disturbances of fabric transfer, meandering of fabric, longitudinal creases and permanent creases are produced.

In the present invention at the entry of the treating space, the fabric is led in open width and folded in a given wavy form as snugly as possible and carried forward in the same form. Fluids are blown through jet nozzles to the moving fabric from outside the treating space at a specified jet angle. By these improvements, the fabric is opened and held along the length of the fabric in a relaxed state in the treating space. Since the fluid is blown from outside the treating space, excessive tension variations will not occur. The fabric is supplied with fresh treating fluids from both sides of the treating space and given a continuous treatment uniformly and rapidly.

The object of the present invention is to provide an apparatus for processing fabric by feeding folded fabric into a treating space, holding it properly in that space and blowing a treating fluid on both sides of the fabric to ensure that the flow of fluid is even and that all parts of the fabric receive adequate treatment.

The present invention will be described below with reference to the accompanying drawings.

Figure 1:
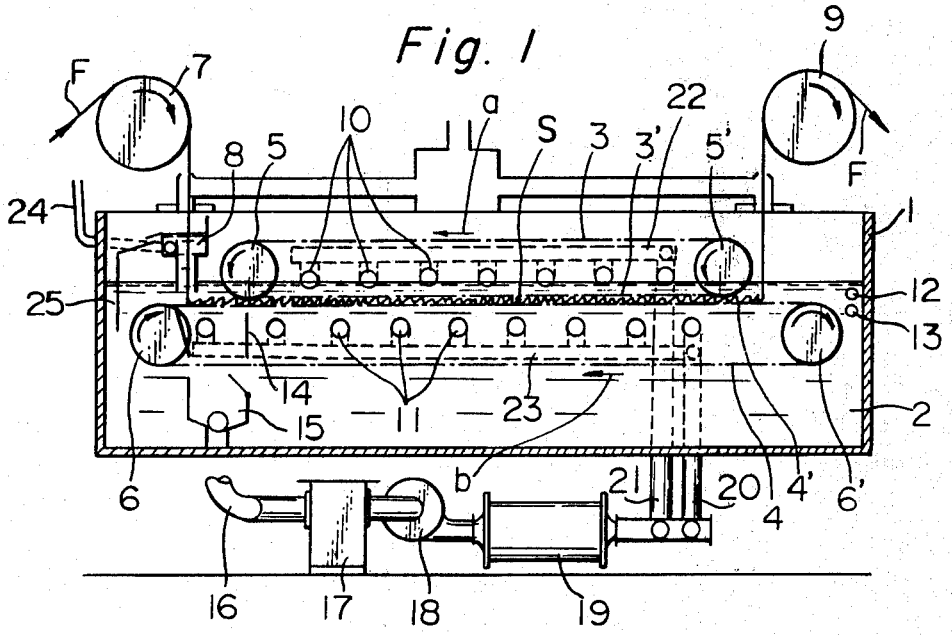
FIG. 1 is a vertical side view of an apparatus of the present invention.

In FIG. 1, in treating tank 1 containing a treating fluid are horizontally disposed two fluid-penetrable upper and lower conveyors 3, 4. Upper conveyor 3 is supported with rotary rollers 5, 5′ and lower conveyor 4 with rotary rollers 6, 6′. A space formed with the lower run 3′ of upper net conveyor 3 and the upper run 4′ of lower conveyor 4 is for use in treating fabric. Lower run 3′ and upper run 4′ run in directions *a*, *b*, that is, the same direction. Fabric F is fed from supply roller 7 to conveyor 4 via cascade tank 8, then runs in treating space S while it is being held with runs 3′, 4′ of the two conveyors facing each other, leaves tank 1 and winds itself around delivery roller 9. A plurality of jet nozzles 10, 11 are disposed outside treating space S, alternately facing each other to permit jets of fluid to penetrate facing runs 3′, 4′ and act on fabric F. Treating tank 1 is provided with overflow holes 12, 13 for determining the fluid level in the tank. The treating fluid in tank 1 is collected into collecting tube 16 through collecting gutters 14, 15, passes through filter tank 17, pump 18, and heat exchanger 19, is divided into branch tubes 20, 21, reaches nozzles 10, 11 through nozzle headers 22, 23 and blown into treating space S from the nozzles.

The fabric which has left feed roller 7 is led into treating space S through cascade tank 8. The level of cascade tank 8 is rendered higher than that of treating tank 1. Some parts of the treating fluid in cascade tank 8 guides fabric and falls into treating tank 1. Since it is necessary to maintain constant the level of cascade tank 8, fluid should be supplemented. For this purpose, an appropriate amount of a treating fluid is added from a service tank (not shown) outside the treating tank via conduit 24 and an excess treating fluid is led into treating tank 1 via overflow gutter 25.

Figure 2:
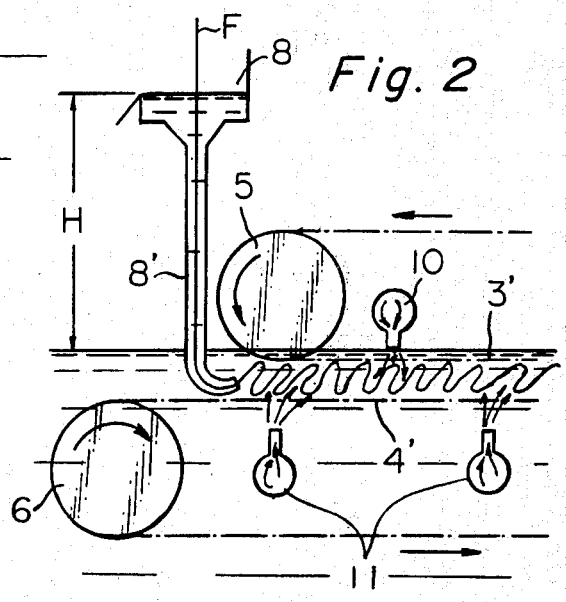
FIG. 2 is an enlarged view of the entry of a treating space.

FIG. 2 shows a structure whereby fabric F is guided into the treating space. Fabric F is guided through cascade 8′ by water head H into the entry of treating space S. The inner width of cascade 8′ is rendered slightly greater than the thickness of fabric F and the fluid in the cascade falls together with the fabric to decrease friction between fabric F and cascade 8′ and facilitate the fall of the fabric. The lower end of the cascade 8′ is bent upward and opened to lower run 3′ of conveyor belt 3. Speeds of runs 3′, 4′ are about the same as each other, but fabric speed in the cascade is rendered greater than the conveyor speed, the difference being controlled by water head H. In this case, as shown in FIG. 2, the fabric is loosely but regularly plaited between runs 3′, 4′ into a folded pile of fabric side by side and it is possible to let height *h* of the wavy form be the same as that of the treating space as in the present invention.

Figure 3:
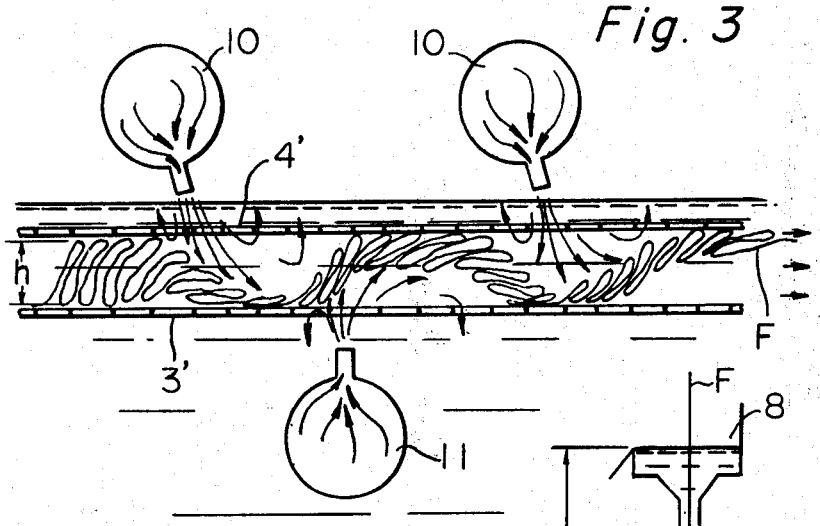
FIG. 3 shows an enlarged treating space of the present invention.

It is well known to insert wavy folded fabric into a treating space. In conventional devices, the wavy form of fabric is irregular. Without a new device as in the present invention, when a wavy form is to be given at the entry of the treating space, the fabric droops and freely oscillates in the absence of a guide. Thus wavy forms tend to be irregular. In contrast, in the present invention, cascade tank 8 and cascade 8′ are disposed at the entry of treating space S to give a given falling speed to the fabric with the use of the falling flow by water head H between cascade tank 8 and treating tank 1 and the bent tip of cascade 8′. The falling speed of fabric is made greater by an appropriate amount than the running speed of runs of the conveyors. In this way, wavy forms having constant dimensions and forms can be produced at the entry of the treating space. Then underneath the formed waves are nozzles 11 arranged to give the folded fabric upward jets of fluid such that the wavy form is uniform and balanced. When the fabric is carried forward in the wavy form, it is pressed on upper run 4′ by means of the treating fluid flowing into fluid collecting gutters 14, 15 disposed below the moving fabric but not distorted much, because fabric F is drawn forward while the two folded edges are being held with the lower run of the upper conveyor belt and the upper run of the lower conveyor belt, which move at the same speed and in the same direction as does fabric F. At this stage, jets of treating fluids are blown from outside both sides of treating space S inwardly through the perforations of the conveyor belts and act as shown in FIG. 3 to change the folded state of the fabric and to equalize the treatment over the whole of the fabric. The change of the folded state ensures that a fresh treating fluid is directly blown to fabric F from both sides of the treating space. Fabric F held in the treating space is alternately reversed up and down, meanders and is changed in its folded state and consequently "an uneven treatment due to folding" which is one conventional difficulty in the treatment of folded fabric is completely eliminated. Fabric F thus processed is drawn out with delivery roller 9. In the present invention, heat exchanger 19 is disposed in the circulating system of the treating fluid to heat the treating fluid because usually a fluid at slightly elevated temperature in the fabric process works better.

Figure 4:
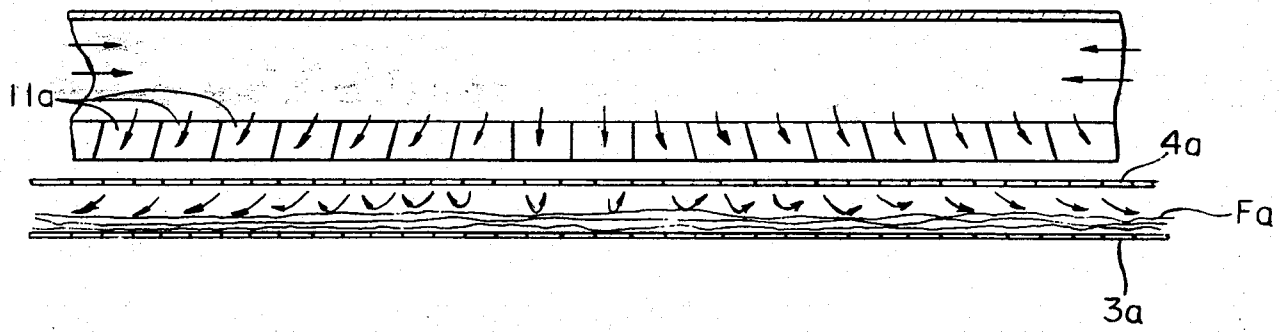
FIG. 4 is a cross sectional front view showing the neighborhood of jet nozzles.

In the present invention, a jet angle of a jet nozzle to be actuated first on the fabric fed to the treating space, which is located on the left side in FIG. 3 is inclined to the moving direction of the fabric. The initial fabric in the treating space is thus pushed forward into the space and effectively guided and it is obvious that accurate folding and formation of a relaxed state of the fabric are obtained. In FIG. 4, numerous nozzles 11*a* are continuously arranged laterally of fabric F*a* carried forward between conveyor belts 3*a*, 4*a* and sectioned perpendicular to the moving direction of fabric F*a*. The jet angles of nozzles 11*a* located around the center of the fabric make right angles with the fabric around the center of the fabric and as nozzles approach to the edges of the fabric from its center, their jet angles become more outwardly opened such that jets of fluid are so blown as to spread the fabric to its width. However, nozzles are not necessarily requested to be symmetrical in their outward openings and as a whole they may be opened outwardly. This arrangement eliminates creases along the length of the fabric, which would otherwise occur during the treatment and helps uncurl the selvages of knitted fabric.

Figure 5:
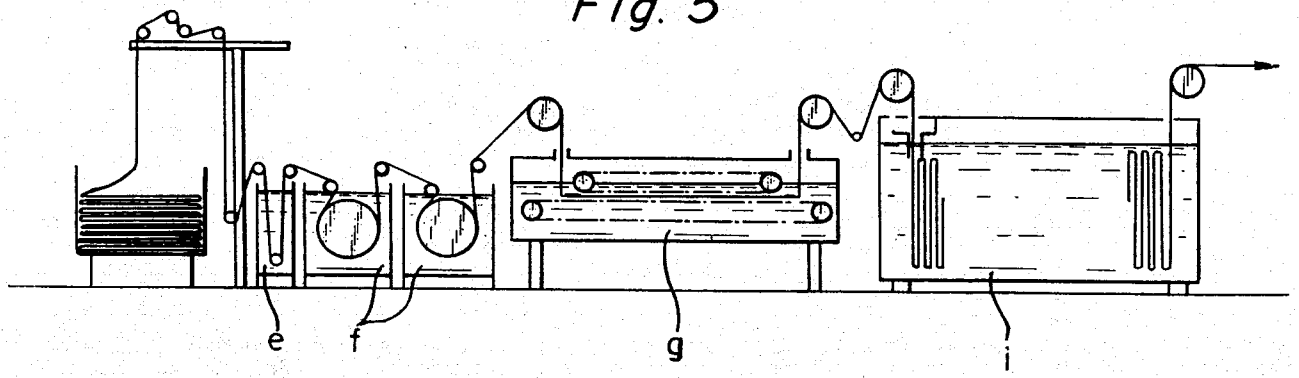
FIG. 5 is a diagram showing an apparatus with accessory members attached in the present invention.

FIG. 5 shows an example of combining the apparatus of the present invention with some other members. Symbol *e* is a preliminary dipping tank, symbol *f* a desizer, symbol *s* the apparatus of the present invention and symbol *h* a hot water washer.

In the present invention, a treating space, which is formed with a pair of fluid-penetrable belt runs can be freely selected from the following locations: the whole of the space as well as nozzles is located in the treating fluid to give the fabric an impingement and turbulent flow treatment in the fluid; some parts of the space are located in the treating fluid to give the fabric around the surface of a treating fluid an impingement to the surface of the treating fluid and a spray treatment; the whole fabric is completely located in the air and positions where an impinging treatment in the air is conducted or the like are freely selected.

Further the direction of the treating space is horizontal as shown in the drawings but may be either vertical or inclined. A pair of members of forming a treating space may move at the same speed and in the same direction, in the same direction and at different speeds, both, or one or other of the two has a greater forward stroke than a backward stroke in the reciprocating movements or both, or one or other traverses laterally of the fabric while being carried forward. In short, those members which move in the same direction as a whole may be in use.

The shape of the treating space is a rectangle having a constant interval as shown in the drawings but it may be a trapezoid having an unequal interval or the one which is curved as a whole.

In the present invention, fabric is folded in a spread-out form and fed into a treating space. Means of spreading fabric to its open width may be a cascade tank or any other well-known type, and except means of folding fabric such that it is naturally piled down in a heap as shown in the drawings, any optional means such as means of swinging fabric back and forth above the pile and folding it or means of pushing fabric into an appropriate enclosure and folding it may be in use.

In short it is sufficient for fabric to be carried forward in a relaxed state along the length of the fabric in a treating space. Jet nozzles require to be disposed on both sides of the treating space. As shown in the drawings those having the same capacities can alternately be arranged in the same number and various modified arrangements of nozzles differing in the number and capacity of nozzles, the distance from the treating space or fluid penetrability through the members forming the treating space can be resorted to. Nozzles may be stationary or movable (e.g., traversing). A fluid blown from nozzles may be a treating liquor or other fluids. For instance, when the treating space is in the treating liquor, steam or air is blown from nozzles to allow the treating liquor to flow toward fabric, and when the treating space is in the air, an optional fluid such as a gas or a liquor is blown for various treatments.

In this way fabric is spread out to its width, held in a relaxed state along the length of fabric in the treating space and treated while a treating liquor is being blown from both sides of the treating space. The fabric can be continuously, evenly and rapidly treated with a fresh treating liquor without high tension variations.

EXAMPLE

Milling and brushing were conducted in the following conditions:

| | | |
|---|---|---|
| Fabric speed | 25 m/min | |
| Preliminary dipping tank | 60° C liquor temp. | washing |
| Scouring tank No. 1 and No. 2 tanks | 75° C liquor temp. | scouring |
| Treating tank | 98° C liquor temp. Retention time of fabric: 5 min Conveyor speed: 2.5 m/min | scouring |
| Washing tank | 90° C liquor temp. Retention time of fabric: 5 min | washing |

Test results are as follows:

| Fabric | | Bulked amunzen | Two folded yarn tropical | Single yarn tropical (Water jet loom) | Delta double cloth |
|---|---|---|---|---|---|
| Yarn | Warp | TSDW 75/36 | TSDW 75/36/2 S 140 | TSDW 100/48 | TSDW 75/24 S 200 |
| | Filling | " | TSDW 75/36/2 | " | " |
| Grey fabric | | 106cm×56m | 107×57 | 97×58 | 77×59.5 |
| Conventional apparatus Rotary washer | | 67cm×39m (36.7%×30.3%) | 80×44 (25.2×22.8) | 83×49 (14.4×15.5) | 125×46 (29.5×22.6) |
| Vibro washer & relaxer | | 81.5cm×47m (23.1%×16.0%) | 94×52 (12.2×8.7) | 93×56 (4×3.4) | — |
| U-box type washer | | 77.5cm×46.5m (26.8%×15.0%) | 84.5×51 (21.0×10.5) | 90.4×54.3 (7.0×6.3) | 144.5×53 (18.3×10.9) |
| Apparatus of the present invention | | 73cm×44m (31%×22.0%) | 79×45 (26×21) | 90×51 (7×12) | 140×50 (21×16) |
| Finishing construction | | 92cm×47.5m (13.4%×15.1%) | 92×48 (14.0×15.7) | 92×52 (5.1×10.3) | 153×51 (13.5×14.2) |

TSDW = polyethylene terephthalate semi-dull stretch yarn
S 140 = S-twist 140 t/m Numerical values parenthesized in the Table stand for percent shrinkage of warp and filling yarn. The greater the numerical values, the greater is the effect of milling and brushing. As is clearly seen in Table, a conventional rotary washer works most effectively but this is of a batch system and productivity is extremely low.

Vibrowashers with a relaxer attached and U-box type washers are of a continuous system but inferior to the apparatus of the present invention. It is evident that continuous operations can be carried out with the apparatus of the present invention with the result of high productivity and effect equal to that of the batch-type rotary washer.

Further with conventional apparatus, the uneven shrinkage (uneven treatment) and unequal width of fabric has occurred, but the apparatus of the present invention has enabled these difficulties to be overcome and brought less trouble in the processings.

What we claim is:

1. An apparatus for continuously treating fabric with a treating fluid comprising a container, roller means mounted in said container for providing parallel conveyor means mounted thereon, said conveyor means comprising an upper conveyor means and a lower conveyor means mounted on said roller means, said conveyor means being fluid penetrable, and used as a path of travel of the fabric, said conveyor means forming a zone for treating fabric, a plurality of jet nozzles outside said treating zone for blowing treating fluid onto said fabric, said jet nozzles being alternately mounted above and below said treating zone and facing each other, said jet nozzles having a first series of jets which is first actuated against the fabric inclined in the moving direction of said fabric, the jet nozzles about the center of the fabric being at right angles with said fabric and the jet nozzles approaching the sides of the fabric becoming opened outwardly, means for providing a fluid descending path for guiding said fabric above the entry of said treating zone, means for regulating the head of the liquid in the descending path so that the descending speed of the fabric caused by the liquid is greater at the entry of the treating zone than the speed at which the conveyor belt moves in the treating zone so as to cause the fabric to result in a wavy form, means for maintaining a predetermined liquid level in said container, and means for supplying fabric into said container for treatment.

2. The apparatus of claim 1 including a fluid outlet tube affixed to a lower portion of said fluid descending path, said fluid outlet tube having a tip end approaching the upper surface of the lower conveyor and bent in the direction of advance of said lower conveyor.

* * * * *

UNITED STATES PATENT AND TRADEMARK OFFICE

CERTIFICATE OF CORRECTION

PATENT NO. : 3,990,274

DATED : November 9, 1976

INVENTOR(S) : Shogo Ito et al.

It is certified that error appears in the above-identified patent and that said Letters Patent are hereby corrected as shown below:

Item 73, line 2, after "Ltd.," insert --Ishikawa-ken--.

Signed and Sealed this

Seventh Day of June 1977

[SEAL]

*Attest:*

RUTH C. MASON
*Attesting Officer*

C. MARSHALL DANN
*Commissioner of Patents and Trademarks*